United States Patent [19]

Springer et al.

[11] 4,007,102

[45] Feb. 8, 1977

[54] ELECTROCOATING ALUMINUM SHEET OR STRIP

[75] Inventors: Willard J. Springer, Livermore; Bruce A. Baker, Jr., Pleasanton, both of Calif.

[73] Assignee: Kaiser Aluminum & Chemical Corporation, Oakland, Calif.

[22] Filed: Dec. 12, 1974

[21] Appl. No.: 532,116

Related U.S. Application Data

[63] Continuation-in-part of Ser. No. 431,853, Jan. 9, 1974, Pat. No. 3,864,230.

[52] U.S. Cl. ..... 204/181

[51] Int. Cl.[2] ..... C25D 13/16; C25D 13/20

[58] Field of Search ..... 204/181

[56] References Cited

UNITED STATES PATENTS 3,454,483 7/1969 Freeman ..... 204/181

OTHER PUBLICATIONS

Newhard, Metal Finishing, July, 1972, pp. 49–53.
Newhard, Metal Finishing, Aug., 1972, pp. 66–69.

*Primary Examiner*—Howard S. Williams
*Attorney, Agent, or Firm*—Paul E. Calrow; Edward J. Lynch

[57] ABSTRACT

This invention generally relates to the electrocoating of metal products and in particular is directed to the treatment of continuous aluminum sheet or strip to form a chromium phosphate type conversion coating thereon, subsequently electrocoating the sheet or strip, applying a top coat and then curing both the electrocoated film and the top coat. The electrocoated sheet or strip exhibits superior coating adhesion.

5 Claims, 1 Drawing Figure

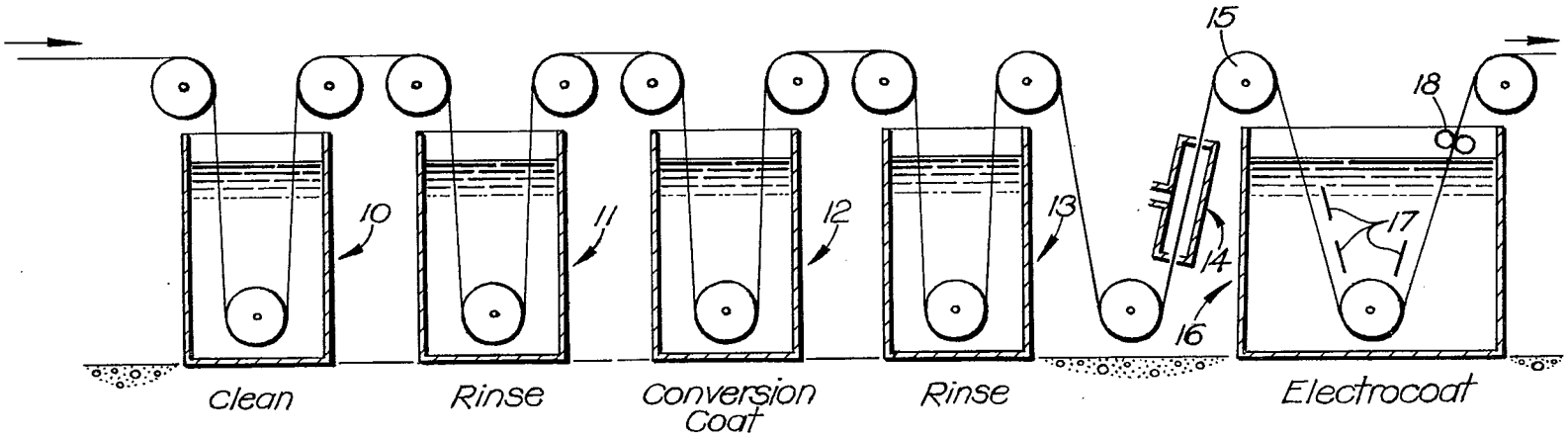
Clean
Rinse
Conversion Coat
Rinse
Electrocoat
10
11
12
13
14
15
16
17
18

ELECTROCOATING ALUMINUM SHEET OR STRIP

RELATED APPLICATIONS

This application is a continuation-in-part of copending application Ser. No. 431,853 filed Jan. 9, 1974, now U.S. Pat. No. 3,864,230.

BACKGROUND OF THE INVENTION

This invention generally relates to an improved method of electrodepositing a water-soluble or water-dispersible coating resin onto a conductive surface, and, in particular, is directed to the formation of a chromium phosphate type conversion coating prior to electrocoating to provide improved cured paint adhesion.

The electrodeposition of water-based coatings, commonly termed electrocoating, is a widely used process which has many advantages over other methods of coating, such as spraying, dipping, rolling and the like. The advantages of electrocoating are well known. The process deposits a film of uniform thickness on essentially any conductive surface, even those which have sharp points and edges. The electrocoated film when applied is relatively water-free, and, thus, will not run or drip when taken out of the bath. Because little or no organic solvents are used in the resin system, the process is essentially fumeless and requires no extensive fume collection and incineration equipment. This latter point is important in view of the increased concern over environmental pollution. An additional advantage is the fact that a second or top coat can be applied over the electrocoated film without curing the electrocoated film and then both coats can be cured in one baking operation. By eliminating the necessity of two furnaces, the cost of a two-coat process can be considerably reduced.

The electrocoating process generally comprises immersing the article to be coated into the electrocoating bath, usually as an anode, and passing a current through the bath between the article and electrode. The process usually is self-arresting in that as the thickness of the coating increases, the resistance thereof also increases, thereby limiting the amount of coating which is electrodeposited.

The overall anodic electrocoating process involves four separate processes, namely, electrophoresis, electrocoagulation, electroendosmosis and electrolysis. Electrophoresis involves driving negatively charged resin particles to the positively charged anode which is the article to be coated. In electrocoagulation, the resin particle loses a negative charge in the close vicinity of the anode or in contact therewith which causes the resin particles to lose their stability and coagulate on or about the anode. Electroendosmosis occurs during and after electrocoagulation and involves driving water out of the coagulated resin, thus, in effect, drying out the electrodeposited coating. Electrolysis also occurs causing evolution of hydrogen at the cathode and oxygen at the anode. With aluminum and other reactive metals, anodic oxidation usually occurs at least initially. Most commercial electrocoating systems are anodic in that the article to be coated is the anode in the electrocoating cell as described above. However, in certain situations, cathodic deposition, wherein the article is the cathode and the coating resin carries a positive charge, has been found useful.

Most commercially available resins for anodic electrocoating generally are polycarboxylic acid-based resins and frequently are acrylic or methacrylic acid-based resins. To solubilize the resins, they are usually completely or nearly completely neutralized by a base, such as an amine or KOH. With cathodic electrocoating, the resin generally is a basic polymer resin which has been neutralized with a soluble acid. During anodic electrocoating, the amine takes on a hydrogen ion and is driven to the cathode where $H_2$ is liberated. The amine or other neutralizing agent is not deposited in the coating and will stay in the bath except for small amounts which are lost through dragout. To maintain a relatively constant level of amine, it is preferred to treat the bath in an ultrafilter or other suitable device to remove amines and other low molecular weight contaminants from the bath. For an excellent discussion on the use of ultrafilters in purifying electrocoating baths, see the article "Ultrafiltration of Electrocoating Systems", in *Nonpolluting Coatings and Coating Processes*, Plenum Press (1973) edited by J. L. Gardon and J. W. Prane. Coupling agents which assist in solubilizing the paint resin are frequently added. The resin can be pigmented or clear as desired.

Due to the fact that after painting most coil coated aluminum sheet is fabricated into such products as roofing, siding, facia systems, gutters, downspouts, shingles and the like, the adhesion between the paint and the aluminum substrate must be at sufficiently high levels to accept the deformation attendant with such fabrication without cracking or pulling away from the aluminum substrate. Much of the prepainted stock is embossed with a pattern (e.g., wood grain and the like) prior to fabrication which provides additional stresses on the conversion coating and paint layers.

Conventional coil coating practice has been to first clean the sheet, form a conversion coating thereon, and then roll one or more coats of paint. Most prepainted aluminum sheet has two coats, a primer coat and a top coat. The purpose of the conversion coat is to provide an improved base for the application of the coating resin so as to more firmly adhere the cured resin to the metal substrate and further to provide improved corrosion resistance.

The ferricyanide accelerated chromic chromate type conversion coating has been almost exclusively used in the continuous coil coating of prepainted aluminum sheet, particularly in those lines wherein the paint is applied by roll coating. This type of coating provides better corrosion resistance and paint adhesion with roll coated products than other conversion coatings, such as chromium phosphate type coatings. The aforesaid conventional coating practice has provided high quality aluminum products which have had service lives of 20 years or more under exposed outdoor condition.

Other conversion coatings, such as chromium phosphate coatings, have been tried in the past but generally they do not provide the level of corrosion resistance or paint adhesion provided by the chromic chromate coating. Chromium phosphate coatings are frequently used as a lacquer base for containers for food and beverages. Occasionally, such coatings are used on paint electrodeposition lines where discrete articles are coated; however, in these cases, there is less concern about adhesion because there is no significant deformation of the substrate and usually only one coat of paint is applied.

The ferricyanide accelerated conversion coating is believed to be $CrFe(CN)_6.Cr(OH)_3.H_2CrO_4.4Al_2O_3.8H_2O$. The chromium phosphate coating is believed to be $Al_2O_3.2CrPO_4.8H_2O$. The water content of the coatings can vary depending upon age and thermal treatment.

The bond between the paint and the substrate of prepainted aluminum sheet is usually evaluated by determining the minimum bend radius the sheet can withstand with no cracking and no removal of the paint coating from the bend area by cellophane tape (e.g., No. 600 Scotch Brand). For commercial acceptability, the prepainted sheet must have a minimum bend radius of 2T ($T$ = thickness of the sheet). Commercially prepared prepainted strip usually has a minimum bend radius between 1T and 2T depending upon temper. If otherwise, the prepainted sheet is incapable of withstanding the deformation characteristic in the fabrication of roofing, siding and similar products.

However, in evaluating the replacement of the primer roll coating step of prior practices with a primer electrocoating step, it was found that such coated products could not be fabricated into products, such as roofing, siding, gutters and the like, because the adhesion between the cured coating and the aluminum substrate was so low (minimum bend radius greater than 2T) that the coatings cracked and pulled away from the aluminum substrate during such fabricating procedures.

It is against this background that the present invention was developed.

DESCRIPTION OF THE INVENTION

This invention generally relates to the electrocoating of continuous aluminum sheet or strip and more particularly is directed to the formation of a chromium phosphate type conversion coating on continuous lengths of sheet or strip prior to the electrocoating thereof. Such conversion coatings within a specified coating weight provide for a substantial improvement in the cured paint adhesion, with minimum bend radius consistently less than 1T, and allow for the subsequent formation of roofing, siding, facia systems, gutters, downspouts, shingles and other similar products from such electrocoated aluminum sheet or strip.

In accordance with the invention, the sheet or strip is treated with an acidic aqueous solution containing hexavalent chromium, phosphate and an accelerator preferably a fluoride so as to form a desired coating weight of about 10–100 milligrams/ft$^2$ (108–1080 mg/m$^2$) preferably about 10–60 mg/ft$^2$ (108–645 mg/m$^2$). Coating weights less than 10 mg/ft$^2$ do not provide adequate corrosion resistance for applications involving outdoor exposure. The acidic solution contains about 4–30 grams/liter hexavalent chromium (expressed as $CrO_3$), about 30–70 grams/liter phosphate (expressed as $H_3PO_4$) and about 1–10 grams/liter fluoride (expressed as NaF). Due to the short treatment times involved in continuous coil coating lines (e.g., 0.5–30 seconds), bath temperatures should exceed 70° F (29.5° C). At temperatures less than 70° F, there is insufficient coating formed to provide adequate adhesion and corrosion resistance. Bath temperatures above 150° F (65.5° C) do not provide the required paint adhesion and corrosion protection. The pH of the acidic solution should be less than 3 but greater than 1. Outside this pH range, the coatings become powdery. Coating thickness will vary from about 500–3000A.

The chromium phosphate conversion coating solution can be made up from commercially available proprietary products, such as Alodine 401–45 sold by Amchem Corporation, Bonderite 702 sold by the Parker Division of Hooker Chemical Corporation and Iridite 30 sold by Allied-Kelite Products Division of the Richardson Company. Such products usually are sold as two components, one containing chromium and phosphate and the other containing fluoride. The fluoride acts as an accelerator and usually is not incorporated into the coating. Other equivalent accelerators can be used.

The overall process of the present invention generally comprises 1. cleaning and degreasing the sheet or strip such as by treating in an inhibited alkaline cleaner or etching in a highly alkaline solution;
2. rinsing with water, preferably deionized;
3. treating in an acidic aqueous solution containing hexavalent chromium, phosphate and preferably fluoride to form an amorphous chromium phosphate type conversion coating;
4. rinsing with water;
5. surface drying the metal product; and
6. electrodepositing a resinous film on the continuous aluminum sheet or strip.

After electrocoating, the aluminum sheet or strip is passed to oven for curing or to additional coating facilities for the application of a top coat thereon. The process of the invention provides for substantially improved product quality, particularly cured coating adhesion and corrosion resistance. Minimum bend radii of less than 1T are consistently obtained.

The electrodeposition of the invention comprises subjecting the continuous sheet, usually as an anode, to electrolysis in an aqueous bath containing about 5–30% by weight of polyelectrolyte resin. The bath temperature is closely controlled (±5° F, ±2.8° C) at a temperature between 60° F (15.5° C) and 130° F (54.5° C). Electrical parameters vary depending upon the nature of the bath but generally range from about 40–300 volts and 10–100 amps/ft$^2$ (1.08–10.8 amp/dm$^2$). Suitable polyelectrolyte resins include Lectropon sold by the DeSoto Paint Company and KWC-376 (CPI) sold by PPG, Inc. Treatment times can vary from about 0.5–30 seconds depending upon strip speed and tank size. After electrocoating, the strip leaves the tank, is squeegee wiped or rinsed to remove excess paint resin and surface dried. The strip is given a top coat to provide a product with the necessary protection for outdoor exposure. Most top coats are applied by roll coating in continuous coil coating lines. Either oil base or water-based paints can be used, but water based are preferred. Generally, the primer coat varies in thickness from about 0.1–0.3 mil (2.5–7.6 mu) and the top coat from about 0.4–1.0 mil (10.2–25.4 mu).

After the top coat is applied, the strip is directed to a furnace to cure both the electrodeposited layer and the top coat. Curing temperatures range from about 250° to 750° F (122°–399° C). Curing times depending upon furnace temperatures and strip speed range from about 0.5–3 minutes. Radiation curing methods, such as electron beam, ultra violet or infrared can be employed, but, as of this date, the technology of these methods are not sufficiently advanced to be competitive with heat curing in continuous coil coating lines.

Reference is made to the drawing which represents an embodiment of overall process of the invention wherein continuous lengths of aluminum sheet or strip are electrocoated. The sheet or strip is first cleaned and degreased (or etched) at 10, rinsed at 11 and then transferred to tank 12 for the formation of an amorphous chromium phosphate type conversion coat. After conversion coating, the strip is rinsed at station 13 and air dried at 14. Following drying, the strip is directed over an electrical contact roll 15 into electrocoating tank 16 containing an aqueous dispersion or solution of electrodepositable polyelectrolyte resin. The strip or sheet passes in close proximity to electrodes 17 (preferably cathodes) where most electrodeposition occurs and then out of the tank for removal of excess resin from the surface by squeegee rollers 18 or by rinsing (not shown). The sheet is surface dried, a second coat is applied, preferably by rolling, and then both coats are cured. Rinsing after electrocoating is not desired due to paint loss and water treatment costs.

To illustrate the advantages of the present invention, the following examples are given:

EXAMPLE 1

Specimens of 3105 aluminum alloy sheet 0.019 inch (0.48 mm) thick were cleaned in an inhibited alkaline cleaning solution, rinsed with deionized water and then were directly electrocoated with a primer coat 0.2 mil (5.1 mu) thick of Lectropon, a polyelectrolyte resin. The electrocoating bath contained 10% by weight resin and was maintained at 95° F (35° C). Electrocoating current density was 30 amp/ft$^2$ (3.2 amp/dm$^2$) and coating time was 5 seconds. After electrocoating, the specimens were squeegee wiped, surface dried and then roll coated with an oil-base paint CPI Duracron 100 to a total paint thickness of 0.7 mil (17.8 mu). After top coat application, the specimens were cured at 480° F (249° C) for 80 seconds. All process steps were controlled so as to accurately simulate continuous coil coating procedures. The specimens passed the bend test (minimum bend radius less than 2T) but all samples fail SWAACT accelerated corrosion tests (200 hours exposure Sea Water Acetic Acid Cyclic Test with test chamber operated per QQ-A-00250/20, Federal Specifications).

EXAMPLE 2

Other specimens of the same composition were coated in the manner set for the above in Example 1 except that a chromium phosphate type conversion coating was formed on the specimens after cleaning. The conversion coating was formed by treating for 10 seconds with an acidic (pH 2.3) aqueous solution containing 9.8 gms/liter hexavalent chromium (expressed as $CrO_3$), 4.04 gms/liter phosphate (expressed as $H_3PO_4$) and 4.4 gms/liter fluoride (expressed as NaF). The acidic solution was at 100° F. The solution was prepared by adding 44 gms/liter of Alodine 401 and 7.5 gms/liter of Alodine 45 both sold by Amchem Corporation. Conversion coating weight was approximately 25 mg/ft$^2$ (270 mg/m$^2$). After coating formation, the specimens were rinsed with deionized water and then electrocoated and roll coated in the manner set forth in Example 1. The specimens so treated passed both the bend test (minimum bend radius less than 1T) and accelerated corrosion tests (SWAACT).

EXAMPLE 3

Other specimens of the same size and composition were coated in the manner set forth above in Example 1 except that a ferricyanide accelerated conversion type coating is formed on the specimens after cleaning. The conversion coating was formed by treating for 10 seconds with an acidic aqueous solution containing hexavalent chromium, fluoride and a ferricyanide accelerator. The solution was prepared by adding 7.5 gms/liter of Alodine 1200 (sold by the Amchem Company). The acidic solution was at 100° F. Conversion coating weight was approximately 25 mg/ft$^2$ (270 mg/m$^2$). After coating formation, the specimens were rinsed in deionized water and then electrocoated and roll coated in the manner set forth above in Example 1. The specimens so treated passed the accelerated corrosion tests (SWAACT) but failed the bend test (minimum bend radius greater than 2T).

From the above examples, it is evident that the amorphous chromium phosphate type conversion coating of the invention provides the improved adhesion and good corrosion resistance required for painted sheet and strip which is to be subsequently fabricated by severe deformation into products, such as roofing, siding and the like.

Experimental trials on a commercial-sized coil coating line have confirmed the improved adhesion shown above for the chromium phosphate conversion coating. With the process of the invention, minimum bend radii less than 1T are consistently obtained. Prior processes did not provide this level of adhesion. Initial outdoor exposure tests also confirm the above accelerated corrosion test data.

conventional 0.024 inch (0.61 mm) thick two-coat coil coated sheet which has a chromate conversion coating and which has had both coats roll coated will have a Gardner variable impact rating of about 30 inch pounds ($3.4 \times 10^7$ cm-dynes). Two-coated sheet which has a chromic chromate conversion coating and which the primer coat has been electrodeposited will have a Gardner rating of 0 inch pounds. The two-coated product of the present invention with a chromium phosphate coating will have a Gardner rating of 50 inch pounds ($5.7 \times 10^7$ cm-dynes). A one-coat roll coated product with a chromic chromate type conversion coating will have a Gardner rating of 20 inch pounds ($2.3 \times 10^7$ cm-dynes). The Gardner variable impact test rating is a determination of the maximum impact in inch-pounds the coated product can withstand without coating removal when tested with No. 600 Scotch brand cellophane tape or its equivalent. (See National Coil Coaters Assoc. Tech. Bulletin No. 11-6.)

As used herein, sheet or strip refers to continuous lengths of aluminum sheet or strip less than 0.125 inch (3.2 mm) thick.

It is obvious that various modifications and improvements can be made to the invention without departing from the spirit thereof and the scope of the appended claims.

What is claimed is:

1. In the method of coating continuous lengths of aluminum sheet or strip which can be subjected to severe deformation in subsequent fabrication steps wherein said sheet or strip is cleaned, treated to form thereon a chemical conversion coating, coated with a primer coat and then coated with a top coat, the improvement comprising forming said chemical conversion coating by treating said sheet or strip for not more than 30 seconds with an acidic aqueous solution containing hexavalent chromium, phosphate and fluoride so as to form thereon from about 10–100 Mg/ft$^2$ (108–1080 $Mg/m^2$) of a chromium phosphate conversion coating, applying the primer coat by electrocoating a water-based polyelectrolyte resin onto the sheet or strip, applying the top coat in a suitable fashion onto the electrocoated resin and then curing both the electrocoated resin primer coat and the top coat in a single curing step.

2. The method of claim 1 wherein the said acidic aqueous solution contains 4–30 gms/liter chromium expressed as $CrO_3$, 2–70 gms/liter phosphate expressed as $H_3PO_4$ and 1–10 gms/liter fluoride expressed as NaF.

3. The method of claim 1 wherein the sheet or strip is treated with said acidic solution for about 0.5–30 seconds.

4. The method of claim 3 wherein the temperature of said acidic solution ranges from about 70° to 150° F (29.5–65.5° C).

5. The method of claim 1 wherein said conversion coating weight ranges from 10–60 $mg/ft^2$ (108–645 $mg/m^2$).

* * * * *